US006943784B2

(12) United States Patent
Kuo et al.

(10) Patent No.: US 6,943,784 B2
(45) Date of Patent: Sep. 13, 2005

(54) CONTROL CIRCUIT OF PANEL BRIGHTNESS

(75) Inventors: Hubert Kuo, Shindian (TW); Yu-Bin Cho, Shinjuang (TW)

(73) Assignee: VIA Technologies, Inc., Taipei (TW)

( * ) Notice: Subject to any disclaimer, the term of this patent is extended or adjusted under 35 U.S.C. 154(b) by 421 days.

(21) Appl. No.: 10/108,893

(22) Filed: Mar. 29, 2002

(65) Prior Publication Data

US 2002/0163489 A1 Nov. 7, 2002

(30) Foreign Application Priority Data

May 1, 2001 (TW) ..... 90110443 A

(51) Int. Cl.[7] ..... H04N 5/268

(52) U.S. Cl. ..... 345/204; 345/87; 345/89; 345/205; 345/207; 345/214; 345/690; 349/19; 349/56; 349/102

(58) Field of Search ..... 345/87, 89, 204, 345/205, 207, 214, 690; 349/19, 56, 102

(56) References Cited

U.S. PATENT DOCUMENTS 3,838,209 A * 9/1974 Tsuchiya et al. ..... 348/800
4,180,813 A * 12/1979 Yoneda ..... 345/100
4,578,698 A * 3/1986 Miki et al. ..... 348/600
4,859,057 A * 8/1989 Taylor et al. ..... 600/473
5,111,243 A * 5/1992 Hatano ..... 399/81
5,206,633 A * 4/1993 Zalph ..... 345/92
5,499,120 A * 3/1996 Hansen ..... 349/62
6,464,633 B1 * 10/2002 Hosoda et al. ..... 600/178

* cited by examiner

*Primary Examiner*—Bipin Shalwala
*Assistant Examiner*—Vincent E. Kovalick
(74) *Attorney, Agent, or Firm*—Rabin & Berdo, P.C.

(57) ABSTRACT

A control circuit of panel brightness is disclosed. After a user adjusts a brightness volume control, the brightness volume control will output an adjusting signal. The control circuit of this invention includes a pre-stage circuit, a first brightness control circuit, and a second brightness control circuit. The pre-stage circuit is fro receiving a darkness-adjusting signal, a brightness-adjusting signal, and an enable signal. A first brightness value outputted from the first brightness control circuit can be the first brightness value of the previous time point plus or minus a interval. A second brightness value outputted from the second brightness control circuit can be the second brightness value of the previous time point plus or minus a interval. The first brightness value and the second brightness value are for adjusting panel brightness. The circuit of this invention is simple, easy to design, and less cost.

22 Claims, 4 Drawing Sheets

CONTROL CIRCUIT OF PANEL BRIGHTNESS

This application incorporates by reference Taiwanese application Serial No. 90110443, Filed on May 1, 2001.

BACKGROUND OF THE INVENTION

1. Field of the Invention

This invention relates to a control circuit of panel brightness, and more particularly to a control circuit of panel brightness of Liquid Crystal Display (LCD).

2. Description of the Related Art

In notebooks, an Embedded Controller (EC) is for controlling panel brightness of a Liquid Crystal Display, such as DSTN LCD. The function of the Embedded Controller is similar to the function of a processor. With the program instruction codes of the Embedded Controller, EC helps to control multiple peripheral devices of the notebook. The above mentioned panel brightness control is only one of its functions.

Furthermore, the Embedded Controller is substantially a microprocessor, which controls Read Only Memory, Random Access Memory, Clock Generator, Registers, Input/Output devices, and so on, by instruction sets designed by a software program, and the Embedded Controller enables to execute the functions of data read/write, operation, storage, and so on. By using the Embedded Controller to execute the operation of a keyboard device in a notebook, it will cause the following problems. Firstly, it needs not only a complicate circuit producing process to manufacture the Embedded Controller, but also a software program to write an instruction set for the control operation of circuit components of the Embedded Controller. Moreover, in order to link the Embedded Controller with the external Basic Input/Output System (BIOS), manufacturers must also pay the royalty fee to get the license of instruction sets for controlling external Basic Input/Output System. The Embedded Controller may have similar function as a microprocessor, which includes more powerful and complicate functions compared with an ordinary logic circuit. However, it costs much more to produce the Embedded Controller than an ordinary logic circuit for manufactures.

Every manufacturer of Embedded Controllers designs different circuit and different software instruction sets. Every circuit performance of Embedded Controllers generated by different manufacturers is not all the same. Therefore, generally speaking, system manufacturers of notebooks are preferred to use products of a specific Embedded Controller manufacturer. But at this present, there are few manufacturers to produce Embedded Controllers, notebook system manufacturer cannot have much choice for the sources of Embedded Controllers. When there is more demand from system manufacturer than supply from manufactures of Embedded Controller, Embedded Controllers will be out of stock. Therefore it will badly affect the quantity and efficiency of producing notebooks for system manufacturers. Additionally, bigger system manufacturers always monopolize the sources of Embedded controllers. For smaller system manufacturers, the shortage situation will happen unpredictable, and the probability is more than bigger manufacturers. The influence on smaller manufacturers is more serious.

When Embedded Controllers are out of stock, the system manufacturers cannot help but change the variety of Embedded Controllers installed in notebooks. It means to buy Embedded Controllers from other Embedded Controller manufacturer. But as it is mentioned above, circuits and software instruction sets designed for one kind of Embedded Controller may not suitable for another kind of Embedded Controller. It makes performance of Embedded Controllers produced by each manufacturer not all the same. When the system manufacturers uses another kind of Embedded Controllers, they need to redesign a set of instruction codes for new electric components to control new Embedded Controllers, in order to execute required tasks. That increases much time and cost. Furthermore, even they have changed new Embedded Controllers, due to the limited source; there are not many choices. So the problem, that manufacturers might run out of stock, maybe still happen again. System manufacturers then cannot help but seek another supply of Embedded Controllers.

Therefore, it costs a lot to control panel brightness by using Embedded Controllers. The main reason is that the price of Embedded Controllers is very high, and the production of Embedded Controllers is limited in the world, which would easily cause shortage of stock. Besides, it needs to design additional instruction codes related to the Embedded Controller. It is rather inconvenient and time consuming.

SUMMARY OF THE INVENTION

It is therefore an object of the invention to provide a control circuit of panel brightness, which does not need traditional Embedded Controllers. It needs only several digital logic circuits to achieve the required efficiency. The circuit is simple and easy to design. It does not need to design other related instruction codes, costs less and is easy to use.

The invention achieves the above-identified objects by providing a control circuit of panel brightness. When a user adjusts a brightness control, the brightness control will output an adjusting signal. The control circuit of this invention comprises a pre-stage circuit, a first brightness control circuit, and a second brightness control circuit. The pre-stage circuit is for receiving an adjusting signal and generating a darkness-adjusting signal and a brightness-adjusting signal related to the adjusting signal. And the pre-stage circuit furthermore outputs an enable signal related to the darkness adjusting signal and brightness adjusting signal. The first brightness control circuit is for outputting a first brightness value, which has been adjusted by the user, and for receiving the first brightness value in a previous time point. The first brightness control circuit is controlled by the enable signal, the darkness-adjusting signal, or the brightness-adjusting signal. Wherein, the first brightness value can be the first brightness value in the previous time point adding or subtracting an interval value. And the second brightness control circuit is for outputting a second brightness value, which has been adjusted by the user, and for receiving the second brightness value in a previous time point. The second brightness control circuit is controlled by the enable signal, the darkness-adjusting signal, or the brightness-adjusting signal. Wherein, the second brightness value can be the second brightness value in the previous time point adding or subtracting an interval value. Wherein, The first brightness value and the second brightness value are for adjusting panel brightness.

BRIEF DESCRIPTION OF THE DRAWINGS

Objects, features, and advantages of the invention will become apparent from the following detailed description of the preferred but non-limiting embodiments. The description is made with reference to the accompanying drawings, in which.

DESCRIPTION OF THE PREFERRED EMBODIMENT

Figure 1:
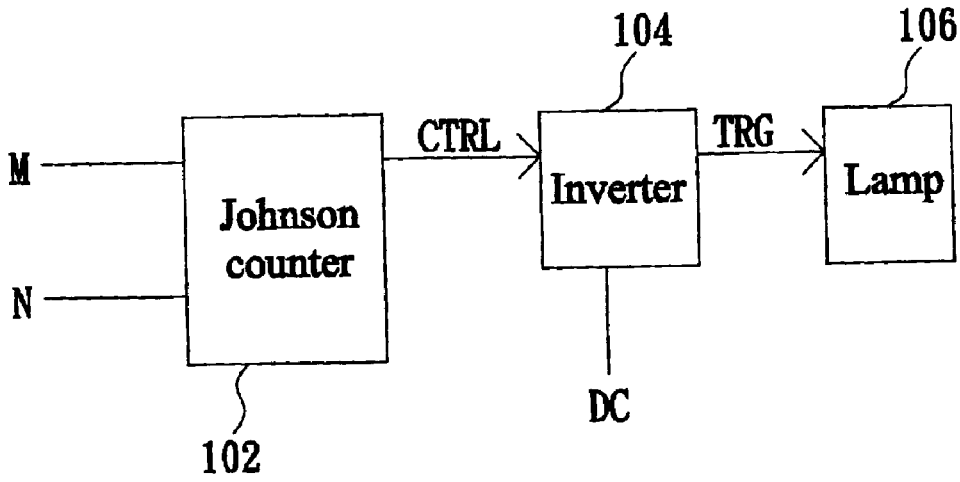
FIG. 1 (PRIOR ART)
FIG. 1 is a system structure diagram that is for starting up a lamp.

The panel of background lighting Liquid Crystal Display in a notebook uses a lamp as the source of background light. General speaking, the brightness of light is controlled by a brightness control signal. Please refer to FIG. 1, which is a system structure diagram that is for starting up a lamp. Brightness values, M and N, are inputted into a Johnson counter 102. The Johnson counter 102 serially outputs a brightness control signal CTRL to an inverter 104. After receiving a direct voltage signal DC, the inverter 104 generates a trigger signal TRG (about 1000V) of alternating high voltage and low current to trigger a lamp 106. Brightness of the lamp can be changed according to different trigger signal TRG, which is different with different brightness control signal CTRL.

Figure 2:
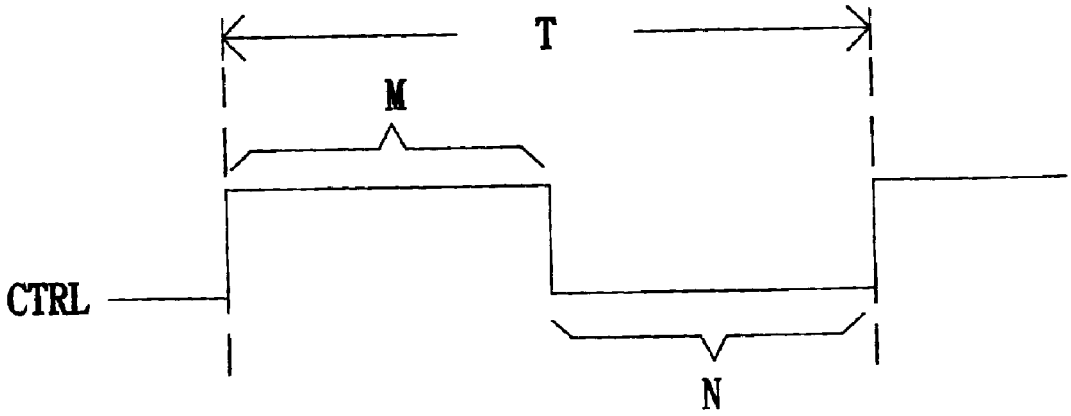
FIG. 2 (PRIOR ART)
FIG. 2 is an illustration that shows the waveform of the brightness control signal CTRL, which is outputted from a Johnson counter.

Wherein, if the Johnson counter 102 receives Brightness values, M and N, the duty ratio of the brightness control signal CTRL outputted from the Johnson counter 102 is M/N. The waveform is illustrated in FIG. 2. The period of the brightness control signal CTRL is T. Within the period T, the numbers of logic 1 (related to M) and logic 0 (related to N) of the brightness control signal CTRL are equal to M+N. The brightness of the lamp 106 is relative to the radio of the brightness values M and N, which is M/N. When the value of the ratio of M/N becomes bigger, the brightness of the lamp 106 increases. When the value of the ratio of M/N becomes smaller, the brightness of the lamp 106 then decreases.

There is a brightness volume control installed at the side of the Liquid Crystal Display in order to make it convenient for users to proceed with brightness adjustment. Users can just control the brightness volume control to achieve the adjustment of panel brightness of the Liquid Crystal Display. The brightness volume control, for example, includes a brightness button and a darkness button. The brightness of panel is decided by the times of the brightness button or darkness button pressed by user.

Figure 3A:
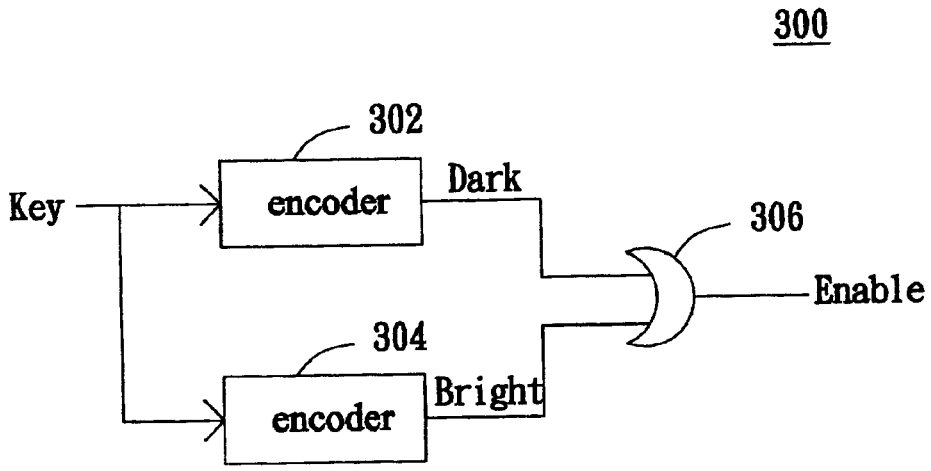
FIG. 3A~3C illustrate a diagram of a control circuit of panel brightness according to the preferred embodiment of the invention.
Figure 3B:
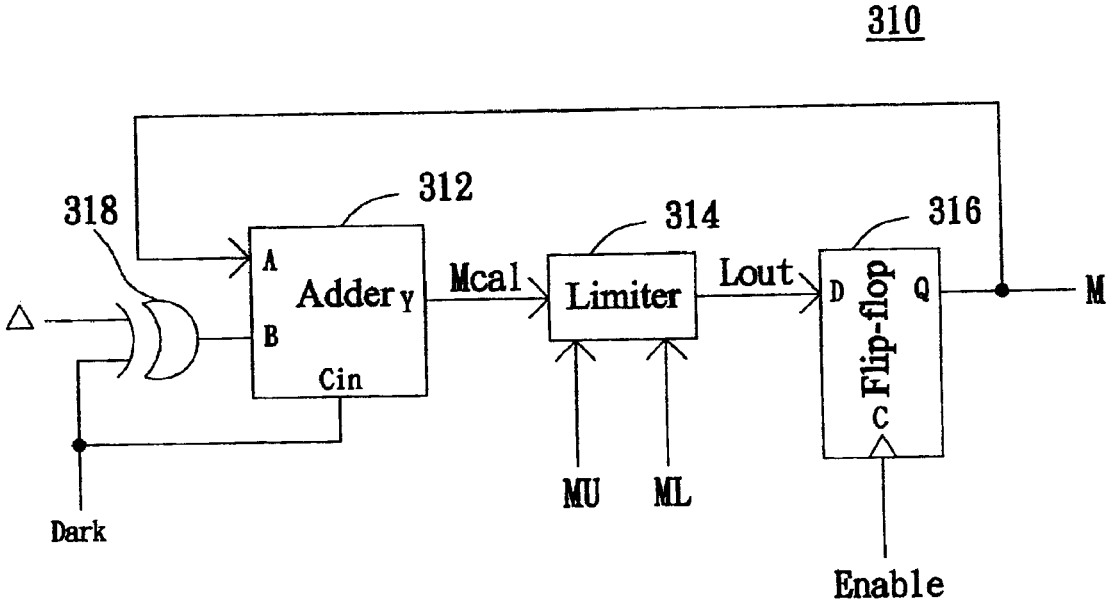
Figure 3C:
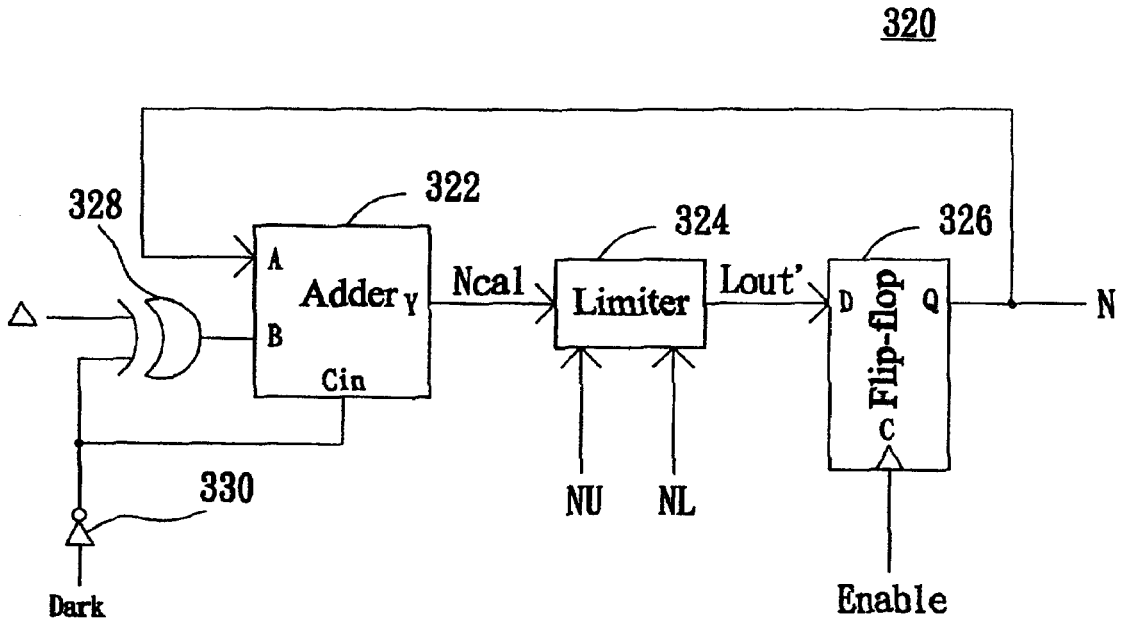

Please refer to FIG. 3A~3C, which illustrate a diagram of a control circuit of panel brightness according to the preferred embodiment of the invention. Wherein, FIG. 3A shows the diagram of the pre-stage circuit of the control circuit of this invention. FIG. 3B and FIG. 3C are respectively the diagrams of brightness adjusting control circuit and darkness adjusting control circuit. When a user adjusts the above-mentioned brightness volume control, the brightness adjusting volume control will output an adjusting signal Key. The adjusting signal Key is inputted into encoders 302 and 304 of the pre-stage circuit 300. The encoders 302 and 304 output a darkness-adjusting signal Dark and a brightness-adjusting signal Bright according to the adjusting signal Key. The darkness adjusting signal Dark and the brightness adjusting signal Bright are simultaneously inputted into an OR-gate 306 to generate an enable signal Enable. The enable signal Enable is for triggering the brightness adjusting control circuit and the darkness adjusting control circuit. Wherein, when the darkness-adjusting signal Dark is on logic 1, it symbolizes a user pushed the darkness-adjusting button in order to darken panel brightness. And when the brightness-adjusting signal Bright is on logic 1, it symbolizes a user pushed the brightness-adjusting button in order to brighten panel brightness. The darkness adjusting signal Dark and the brightness adjusting signal Bright are inverted to each other. When one of the darkness adjusting signal Dark and the brightness adjusting signal Bright is on logic 1, it symbolizes that panel brightness will be adjusted, so the enable signal Enable will also turn to be logic 1 to trigger the brightness adjusting control circuit and the darkness adjusting control circuit.

In FIG. 3B, a brightness adjusting control circuit 310 is for outputting a brightness value M, which is adjusted by the user. The brightness adjusting control circuit 310 includes an adder 312, a limiter 314, and a flip-flop 316. Suppose that the user pressed the above mentioned brightness adjusting button or darkness adjusting button each time, the value M will increase or decrease an interval Δ. The interval Δ and the darkness adjusting signal Dark are inputted at the same time into a exclusive-or (XOR) logic circuit 318, which proceed with exclusive-or operation of the interval Δ and the darkness adjusting signal Dark. The output of the exclusive-or logic circuit 318 is inputted into an input end B of an adder 312. Furthermore, an input end A of the adder 312 is for receiving the brightness value M, which is fed-back from the brightness adjusting control circuit 310.The darkness adjusting signal Dark is furthermore outputted into a clock pulse control end Cin of the adder 312. When the darkness adjusting signal Dark is enabled (for example on logic 1), the adder 312 will proceed with addition operation. The adder 312 adds the data inputted into the input ends A and B, and outputs an adjusted brightness value Mcal through an output end Y. The adjusted brightness value Mcal is outputted into the limiter 314.

The following is the explanation of the operation theory of the adder 312 in detail. When the darkness adjusting signal Dark is equal to logic 1, the formula of the adjusted brightness value Mcal is as following:

$$Mcal=M+\Delta'+1=M-\Delta$$

Wherein, Δ' is a conjugate of Δ. When the darkness adjusting signal Dark is equal to logic 0, the formula of the adjusted brightness value Mcal is as following:

$$Mcal=M+\Delta$$

Next, the adjusted brightness value Mcal is inputted into the limiter 314. And the limiter 314 furthermore receives the upper limit value MU and the lower limit value ML of M. The upper limit value MU and the lower limit value ML of M are related to the maximum and minimum of the allowable brightness value M set by the lamp 106.When the adjusted brightness value Mcal is between the upper limit value MU of M and the lower limit value ML of M, the limiter 314 will use the adjusted brightness value Mcal as a limiter output Lout. When the adjusted brightness value Mcal is greater than the upper limit value MU of M, the limiter 314 will use the upper limit value MU of M as the limiter output Lout. And when the adjusted brightness value Mcal is smaller than the lower limit value ML of M, the limiter 314 will use the lower limit value ML of M as the limiter output Lout.

Next, the output Lout of the limiter is inputted into a flip-flop 316. The enable signal Enable outputted by the pre-stage circuit 300 is inputted into a clock pulse end C of the flip-flop 316, which is for controlling the flip-flop 316. When there is a rising edge in the enable signal Enable, it means the enable signal Enable is turning to logic 1. The brightness value M outputted from the output end Y of the flip-flop 316 is equal to the limiter output Lout.

The operation of a N-value control circuit 320 in FIG. 3C is similar to the brightness control circuit 310 in FIG. 3B. The darkness adjusting control circuit 320 is for outputting a brightness value N, which is adjusted by the user. The darkness adjusting control circuit 320 includes an adder 322, a limiter 324, and a flip-flop 326. The interval Δ and the darkness adjusting signal Dark, which is processed by the inverter 330, are inputted at the same time into a exclusive-or logic circuit 328, which proceed with exclusive-or operation of the interval Δ, and the inverted darkness adjusting signal Dark. The output of the exclusive-or logic circuit 328 is inputted into an input end B of an adder 322. Furthermore, an input end A of the adder 322 is for receiving the darkness value N, which is fed-back from the darkness adjusting control circuit 320.The inverted darkness adjusting signal Dark is furthermore outputted into a clock pulse control end Cin of the adder 322. When the inverted darkness adjusting signal Dark is enabled (for example, the darkness adjusting signal Dark is logic 1), the adder 322 will proceed with addition operation. The adder 322 adds the data inputted into the input ends A and B, and gets an adjusted brightness value Ncal through an output end Y The adjusted brightness value Ncal is outputted into the limiter 324.

Wherein, because the darkness adjusting signal Dark, and the brightness adjusting signal Bright are mutual exclusive, in FIG. 3, the inverted darkness adjusting signal Dark is inputted into the exclusive-or logic circuit 328, and is the input of the clock pulse control end Cin of the adder 322. It is still within the spirit of this invention if the brightness adjusting signal Bright is direct inputted.

The operation of the adder 322 is as following. When the darkness adjusting signal Dark is equal to logic 0, the adjusted brightness value Ncal=N+Δ'+1=N−Δ. When the darkness adjusting signal Dark is equal logic 1, the adjusted brightness value Ncal=N+Δ.

Next, the adjusted brightness value Ncal is inputted into the limiter 324, and the limiter 324 further receives the upper limit value NU and the lower limit value NL of N. The upper limit value NU and the lower limit value NL of N are related to the maximum and minimum of the allowable brightness value N set by the lamp 106. When the adjusted brightness value Ncal is between the upper limit value NU of N and the lower limit value NL of N, the limiter 324 will use the adjusted brightness value Ncal as a limiter output Lout. When the adjusted brightness value Ncal is greater than the upper limit value NU of N, the limiter 324 will use the upper limit value NU of N as the limiter output Lout. And when the adjusted brightness value Ncal is smaller than the lower limit value NL of N, the limiter 324 will use the lower limit value NL of N as the limiter output Lout.

Next, the limiter's output Lout is inputted into a flip-flop 326. The enable signal Enable outputted by the pre-stage circuit 300 is inputted into a clock pulse end C of the flip-flop 326, which is for controlling the flip-flop 326. When there is a rising edge in the enable signal Enable, it means the enable signal Enable is turning to logic 1. The brightness value N outputted from the output end Y of the flip-flop 326 is equal to the limiter output Lout.

It is, therefore, that when a user pushes the brightness adjusting button once, the brightness adjusting button will output an adjusting signal Key, which makes the pre-stage circuit 300 generate a brightness signal Bright with logic 1, and a darkness signal Dark with logic 0, and generates an enable signal Enable with logic 1. At this moment, the brightness adjusting control circuit 310 will output a brightness value M(t+1)=M(t)+Δ, and the darkness adjusting control circuit 320 will output a brightness value N(t+1)=N(t)−Δ. At this moment, the ratio of the brightness values M and N is $$M(t+1)/N(t+1)=(M(t)+\Delta)/(N(t)-\Delta)>M(t)/N(t)$$

Because the ratio of the brightness values M and N increases, it effectively changes the output of the Johnson counter, which makes the panel of the Liquid Crystal Display brighter.

If the user pushes the brightness adjusting button twice, the ratio of the brightness values M and N will increase as (M(t)+2Δ)/(N(t)−2Δ), which will make the panel brighter. It means the panel brightness changes according to the times as the user pushes the brightness-adjusting button.

In the same theory, when the user pushes the darkness adjusting button once, the brightness adjusting button will output an adjusting signal Key (which makes the pre-stage circuit 300 generate a brightness signal Bright with logic 0 and a darkness signal Dark with logic 1) and generates an enable signal Enable with logic 1. At this moment, the brightness adjusting control circuit 310 will output a brightness value M(t+1)=M(t)−Δ, and the darkness adjusting control circuit 320 will output a brightness value N(t+1)=N(t)+Δ. At this moment, the ratio of the brightness values M and N is $$M(t+1)/N(t+1)=(M(t)-\Delta)/(N(t)+\Delta)<M(t)/N(t)$$

Because the ratio of the brightness values M and N decreases, it effectively changes the output of the Johnson counter, which makes the panel of the Liquid Crystal Display darker.

If the user pushes the darkness adjusting button twice, the ratio of the brightness values M and N will increase as (M(t)−2Δ)/(N(t)+2Δ), which will make the panel darker. It means the panel brightness changes according to the times as the user pushes the darkness-adjusting button.

Wherein, the default values of the related values in FIG. 3A~3C can be stored in an Electrically Erasable Programmable Read Only Memory (EEPROM) in the Liquid Crystal Display. The EEPROM includes, for example, a field for the initial value of the brightness value M, a field for the initial value of the brightness value N, a field for the interval value Δ, a field for the upper limit value MU of M, a field for the lower limit value ML of M, a field for the upper limit value NU of N, and a field for the lower limit value NL of N. After the Liquid Crystal Display starts, the values in the EEPROM will be loaded, wherein, the initial value of M in the field for the initial value of the brightness value M, and the initial value of N in the field for the initial value of the brightness value N are loaded for the initial brightness of the Liquid Crystal Display. The other values of fields are for the input values for operating the control circuit of panel brightness of this invention, when a user adjusts the panel brightness.

Figure 4:
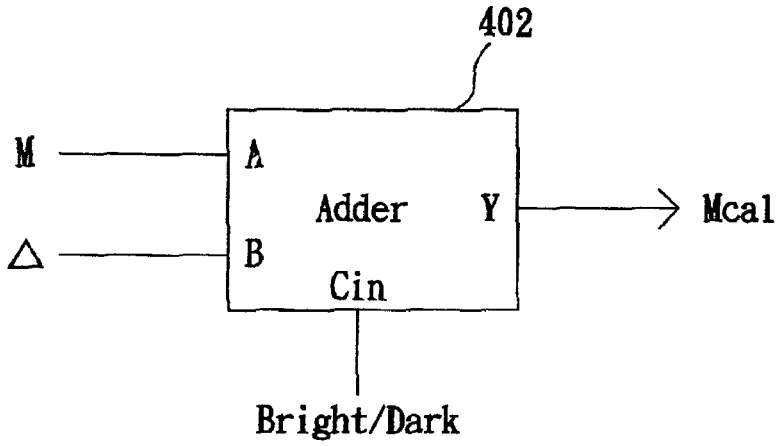
FIG. 4 is an illustration that shows another circuit diagram of an adder, which is for accomplishing the invention.

The adders 312 and 322 in FIG. 3B and FIG. 3C can be implemented by other type of adders. There is an example to explain. Please refer to FIG. 4, which is an illustration that shows another circuit diagram of an adder, which is for accomplishing the invention. A adder 402 includes an input end A and input end B, which are respectively for receiving the brightness value M and the interval Δ. Wherein, a clock pulse control end Cin is for receiving the brightness adjusting signal Bright or the darkness adjusting signal Dark, which makes the adder 402 be controlled by the brightness adjusting signal Bright or the darkness adjusting signal Dark. And the adder 402 outputs the adjusted brightness value Mcal via an output end Y. Unlike the adders 312 and 322, the adder 402 can direct proceed with operations of addition and subtraction. The followings are the explanations when the adder 402 receives the brightness adjusting signal Bright, and the dark adjusting signal Dark respectively. When the adder 402 accepts the control of the brightness adjusting signal Bright, if the brightness adjusting signal Bright is logic 1, the adder 402 will output an adjusted brightness value Mcal, which is equal to M+Δ. If the brightness adjusting signal Bright is logic 0, the adder 402 will output an adjusted brightness value Mcal, which is equal to M−Δ. When the adder 402 accepts the control of the darkness adjusting signal Dark, if the darkness adjusting signal Dark is logic 1, the adder 402 will output an adjusted brightness value Mcal, which is equal to M−Δ. If the darkness adjusting C signal dark is logic 0, the adder 402 will output an adjusted brightness value Mcal, which is equal to M+Δ.

In the same way, the adder 322 can be accomplished almost the same as the adder 402. The difference is that when this adder accepts the control of the brightness adjusting signal Bright, if the brightness adjusting signal Bright is logic 1, the adder 402 will output an adjusted brightness value Ncal, which is equal to N−Δ. If the brightness adjusting signal Bright is logic 0, the adder 402 will output an adjusted brightness value Ncal, which is equal to N+Δ. When the adder 402 accepts the control of the darkness adjusting signal Dark, if the darkness adjusting signal Dark is logic 1, the adder 402 will output an adjusted brightness value Ncal, which is equal to N+Δ. If the darkness adjusting signal dark is logic 0, the adder 402 will output an adjusted brightness value Ncal, which is equal to N−Δ.

Figures 5A, 5B, 5C, 5D, 5E:
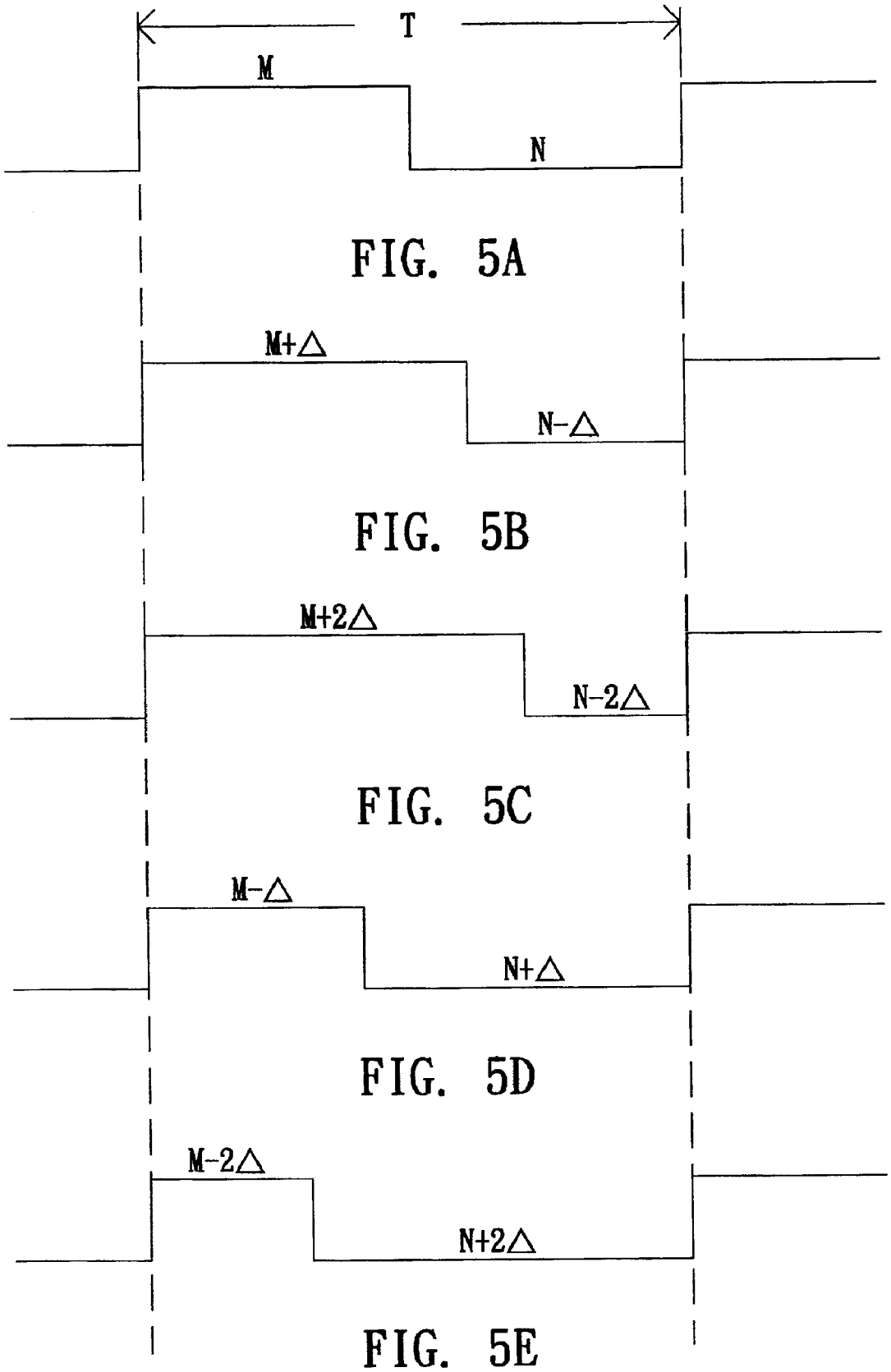
FIG. 5A~5E are illustrations that show the output waveform of the Johnson counter after brightness values M and N are inputted into the Johnson counter.

Please refer to FIG. 5A~5E, which are illustrations that show the output waveform of the Johnson counter after brightness values M, N are inputted into the Johnson counter. Wherein, FIG. 5A is the output waveform before adjustment. FIG. 5B is the output waveform after the user pushes the brightness-adjusting button once. FIG. 5C is the output waveform after the user pushes the brightness-adjusting button twice. FIG. 5D is the output waveform after the user pushes the darkness-adjusting button once. FIG. 5E is the output waveform after the user pushes the darkness-adjusting button twice. As the user's operation, the related brightness values M and N change as well, which acquire a different output waveform of the Johnson counter. Wherein, the sequence of the panel brightness from bright to dark, related to the waveforms in FIG. 5A~5E, are FIG. 5C, FIG. 5B, FIG. 5A, FIG. 5D, and FIG. 5E, according to the panel brightness of the related waveforms.

This invention is implemented to a Liquid Crystal Display, for example Thin Film Transistor Liquid Crystal Display, or Double Super-twisted nematic mode (DSTN) Liquid Crystal Display, by which it is easy to achieve the function of controlling panel brightness.

The above embodiment reveals that the invention, a control circuit of panel brightness, can skip the traditional Embedded Controllers, and only needs simple and a few digital logic circuits to achieve the required effect. The circuit is simple and easy to design. It doesn't need to design related program instruction codes, costs less and is convenient to use.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A control circuit of panel brightness, which responds to an adjustment signal to adjust a panel brightness, comprises:

a pre-stage circuit, for receiving the adjustment signal to obtain a darkness-adjusting signal and a brightness-adjusting signal, the pre-stage circuit further outputting an enable signal related to the darkness-adjusting signal and the brightness-adjusting signal;

a first brightness control circuit, for outputting an adjusted first brightness value and receiving the first brightness value, the first brightness control circuit controlled by the enable signal, the darkness-adjusting signal and the brightness-adjusting signal, wherein the first brightness value is obtained according to the related first brightness value and an interval; and a second brightness control circuit, for outputting an adjusted second brightness value, and receiving a second brightness value, the second brightness control circuit controlled by the enable signal, the darkness-adjusting signal and the brightness-adjusting signal, wherein the second brightness value is obtained according to the second brightness value and an interval;

wherein the first brightness value and the second brightness value are used for adjusting panel brightness.

2. The control circuit as claim 1, wherein the panel brightness is related to the ratio of the first brightness value to the second brightness value.

3. The control circuit as claim 1, wherein the first brightness control circuit comprises:

a first adder, for receiving the first brightness value in a previous time point, and controlled by a control signal, wherein when the control signal is a first value, the first adder outputs a first adjusted brightness value, which is the sum of the first brightness value and the interval, when the control signal is a second value, the first adder outputs a first adjusted brightness value, which is the subtraction of the interval from the first brightness value, and the control signal is either the brightness-adjusting signal or the darkness-adjusting signal;

a first limiter, for receiving the first adjusted brightness value and outputting a first limiter output, wherein when the first adjusted brightness value is between a first upper limit value and a first lower limit value, the first limiter output is equal to the first adjusted value; when the first adjusted brightness value is greater than the first upper limit value, the first limiter output is equal to the first upper limit value; and when the first adjusted brightness value is smaller than the first lower limit value, the first limiter output is equal to the first lower limit value; and a first flip-flop, outputting the first limiter output as the first brightness value when triggered by the enable signal.

4. The control circuit as claim 1, wherein the first upper limit value and the first lower limit value are the allowable values between the maximum and minimum of the first brightness value.

5. The control circuit as claim 1, wherein the second brightness control circuit comprises:

a second adder, for receiving the second brightness value in a previous time point, and controlled by a control signal, wherein when the control signal is a first value, the second adder outputs a second adjusted brightness value, which is the sum of the second brightness value and the interval, when the control signal is a second value, the second adder outputs a second adjusted brightness value, which is the subtraction of the interval from the second brightness value, and the control signal is either the brightness-adjusting signal or the darkness-adjusting signal;

a second limiter, for receiving the second adjusted brightness value, and outputting a second limiter output, wherein when the second adjusted brightness value is between a second upper limit value, and a second lower limit value, the second limiter output is equal to the f second adjusted value, when the second adjusted brightness value is greater than the second upper limit value, the second limiter output is equal to the second upper limit value; and when the second adjusted brightness value is smaller than the second lower limit value, the second limiter output is equal to the second lower limit value; and a second flip- flop, outputting the second limiter output as the second brightness value when triggered by the enable signal.

6. The control circuit as claim 5, wherein the second upper limit value and the second lower limit value are the allowable values between the maximum and minimum of the second brightness value.

7. The control circuit as claim 1, the control circuit is applied to a Liquid Crystal Display.

8. The control circuit as claim 7, the Liquid Crystal Display is a Thin Film Transistor Liquid Crystal Display.

9. The control circuit as claim 7, the Liquid Crystal Display is a Double Super-twisted nematic mode (DSTN) Liquid Crystal Display.

10. The control circuit as claim 1, wherein the first brightness control circuit and the second brightness control circuit each affect a single overall brightness of an entirety of the panel.

11. A control circuit of panel brightness, which responds to an adjustment signal to adjust the panel brightness, comprises:

a pre-stage circuit, for receiving the adjustment signal to obtain a darkness-adjusting signal and a brightness-adjusting signal, the pre-stage circuit further outputting an enable signal related to the darkness-adjusting signal and the brightness-adjusting signal;

a first brightness control circuit, for outputting an adjusted first brightness value, comprising:

a first adder, controlled by the enable signal, for receiving the first brightness value in a previous time point and, outputting a first adjusted brightness value, the first adjusted brightness value being equal to the sum of the first brightness value and the interval, or the subtraction of the interval from the first brightness value;

a first limiter, for receiving the first adjusted brightness value, and outputting a first limiter output related to the first adjusted brightness value, the first limiter output being between the first upper limit value and the first lower limit value; and a first flip-flop, for receiving the first limiter output, and outputting the first brightness value when triggered by the enable signal; and a second brightness control circuit, for outputting an adjusted second brightness value, comprising:

a second adder, controlled by an enable signal, for receiving the second brightness value and outputting a second adjusted brightness value, the second adjusted brightness value being equal to the sum of the second brightness value and the interval, or the subtraction of the interval from the second brightness value;

a second limiter, for receiving the second adjusted brightness value, and outputting a second limiter output related to the second adjusted brightness value, the second limiter output being between the second upper limit value and the second lower limit value; and a second flip-flop, for receiving the second limiter output and outputting the second brightness value when triggered by the enable signal;

wherein the fist brightness value and the second brightness value are for adjusting the panel brightness.

12. The control circuit as claim 11, wherein when the enable signal is a first value, the first adder outputs a first adjusted brightness value, which is the sum of the first brightness value and the interval, and when the enable signal is a second value, the first adder outputs the first adjusted brightness value, which is the subtraction of the interval from the first brightness value.

13. The control circuit as claim 11, wherein, when the first adjusted brightness value is greater than the first upper limit value, the first limiter output is equal to the first upper limit value; and when the first adjusted brightness value is smaller than the first lower limit value, the first limiter output is equal to the first lower limit value.

14. The control circuit as claim 11, wherein when the enable signal is a first value, the second adder outputs a second adjusted brightness value, which is the sum of the second brightness value and the interval, and when the enable signal is a second value, the second adder outputs a second adjusted brightness value, which is the subtraction of the interval from the second brightness value.

15. The control circuit as claim 11, wherein when the second adjusted brightness value is greater than the second upper limit value, the second limiter output is equal to the second upper limit value; and when the second adjusted brightness value is smaller than the second lower limit value, the second limiter output is equal to the second lower limit value.

16. The control circuit as claim 11, the control circuit is applied to a Liquid Crystal Display.

17. The control circuit as claim 16, the Liquid Crystal Display is a Thin Film Transistor Liquid Crystal Display.

18. The control circuit as claim 16, the Liquid Crystal Display is a Double Super-twisted nematic mode (DSTN) Liquid Crystal Display.

19. A method for adjusting brightness of a panel according to an adjustment signal, the panel comprising a pre-stage circuit, a first brightness control circuit, and a second brightness control circuit, the method comprising:

receiving the adjustment signal to obtain a darkness-adjusting signal and a brightness-adjusting signal by the pre-stage circuit;

outputing an enable signal related to the darkness-adjusting signal and the brightness-adjusting signal by the pre-stage circuit;

outputting an adjusted first brightness value and receiving the first brightness value by the first brightness control circuit under the control of the enable signal, the darkness-adjusting signal, and the brightness-adjusting signal, wherein the first brightness value is obtained according to the related first brightness value and an interval; and outputting an adjusted second brightness value, and receiving a second brightness value by the second brightness control circuit under the control of the enable signal, the darkness-adjusting signal, and the brightness-adjusting signal, wherein the second brightness value is obtained according to the second brightness value and an interval; wherein the first brightness value and the second brightness value are used for adjusting panel brightness.

20. The method for adjusting brightness of a panel according to claim 19, the first brightness control circuit including a first adder, a first limiter, and a first flip-flop, the method further comprising:

receiving the first brightness value in a previous time point by the first adder under the control of a control signal, wherein when the control signal is a first value, the first adder outputs a first adjusted brightness value, which is the sum of the first brightness value and the interval, when the control signal is a second value, the first adder outputs a first adjusted brightness value, which is the subtraction of the interval from the first brightness value, and wherein the control signal is either the brightness-adjusting signal or the darkness-adjusting signal;

receiving the first adjusted brightness value and outputting a first limiter output by the first limiter, wherein when the first adjusted brightness value is between a first upper limit value and a first lower limit value, the first limiter output is equal to the first adjusted value; when the first adjusted brightness value is greater than the first upper limit value, the first limiter output is equal to the first upper limit value; and when the first adjusted brightness value is smaller than the first lower limit value, the first limiter output is equal to the first lower limit value; and outputting the first limiter output as the first brightness value responsive to the enable signal by a first flip-flop.

21. A method for adjusting brightness of a panel according to an adjustment signal, comprising:

receiving the adjustment signal to obtain a darkness-adjusting signal and a brightness-adjusting signal;

outputting an enable signal related to the darkness-adjusting signal and the brightness-adjusting signal;

outputting an adjusted first brightness value and receiving the first brightness value under the control of the enable signal, the darkness-adjusting signal, and the brightness-adjusting signal, wherein the first brightness value is obtained according to the related first brightness value and an interval; and outputting an adjusted second brightness value, and receiving a second brightness value under the control of the enable signal, the darkness-adjusting signal, and the brightness-adjusting signal, wherein the second brightness value is obtained according to the second brightness value and an interval;

wherein the first brightness value and the second brightness value are used for adjusting panel brightness.

22. The method for adjusting brightness of a panel according to claim 21, further comprising:

receiving the first brightness value in a previous time point under the control of a control signal;

outputting a first adjusted brightness value, wherein when the control signal is a first value, the first adjusted brightness value is the suni of the first brightness value and the interval, when the control signal is a second value, the first adjusted brightness value is the subtraction of the interval from the first brightness value, and wherein the control signal is either the brightness-adjusting signal or the darkness-adjusting signal;

receiving the first adjusted brightness value and outputting a first limiter output, wherein when the first adjusted brightness value is between a first upper limit value and a first lower limit value, the first limiter output is equal to the first adjusted value; when the first adjusted brightness value is greater than the first upper limit value, the first limiter output is equal to the first upper limit value; and when the first adjusted brightness value is smaller than the first lower limit value, the first limiter output is equal to the first lower limit value; and outputting the first limiter output as the first brightness value responsive to the enable signal.

* * * * *